US009615168B2

(12) United States Patent
Li

(10) Patent No.: US 9,615,168 B2
(45) **Date of Patent: *Apr. 4, 2017**

(54) ADAPTIVE METHOD AND DEVICE OF AUDIO INTERFACE AND ELECTRONIC SIGNATURE TOKEN

(71) Applicant: TENDYRON CORPORATION, Beijing (CN)

(72) Inventor: Dongsheng Li, Beijing (CN)

(73) Assignee: TENDYRON CORPORATION, Beijing (CN)

( * ) Notice: Subject to any disclaimer, the term of this patent is extended or adjusted under 35 U.S.C. 154(b) by 53 days.

This patent is subject to a terminal disclaimer.

(21) Appl. No.: 14/407,700

(22) PCT Filed: Jun. 14, 2013

(86) PCT No.: PCT/CN2013/077223

§ 371 (c)(1),
(2) Date: Dec. 12, 2014

(87) PCT Pub. No.: WO2013/185627

PCT Pub. Date: Dec. 19, 2013

(65) Prior Publication Data

US 2015/0117677 A1 Apr. 30, 2015

(30) Foreign Application Priority Data

Jun. 14, 2012 (CN) ..... 2012 1 0200678

(51) Int. Cl.
*H04R 3/00* (2006.01)
*H04R 5/04* (2006.01)

(52) U.S. Cl.
CPC ..... *H04R 3/00* (2013.01); *H04R 5/04* (2013.01); *H04R 2420/05* (2013.01)

(58) Field of Classification Search
None
See application file for complete search history.

(56) References Cited

U.S. PATENT DOCUMENTS

2005/0053243 A1 3/2005 Ganton
2008/0139042 A1 6/2008 Liang
(Continued)

FOREIGN PATENT DOCUMENTS

CN 102300003 12/2011
CN 102480663 5/2012
(Continued)

OTHER PUBLICATIONS

WIPO, International Search Report for PCT/CN2013/077223, Sep. 19, 2013.

*Primary Examiner* — Joseph J Nguyen
*Assistant Examiner* — Kenny Truong
(74) *Attorney, Agent, or Firm* — Kile Park Reed & Houtteman LLC

(57) ABSTRACT

An adaptive method and device of an audio interface and an electronic signature token are provided. The audio interface comprises a first pin and a second pin, and the method comprises: not implementing an identification operation on the first pin and the second pin of the audio interface when an absolute value of a voltage difference between the first pin and the second pin is less than a first threshold; determining a type of each of the first pin and the second pin according to a sign of the voltage difference between the first pin and the second pin when the absolute value of the voltage difference is greater than or equal to a second threshold, in which the second threshold is greater than or equal to the first threshold; and connecting the identified ground pin to a common ground.

18 Claims, 4 Drawing Sheets

(56) References Cited

U.S. PATENT DOCUMENTS

| | | | | |
|---|---|---|---|---|
| 2008/0175402 | A1* | 7/2008 | Abe | G10K 11/178 381/71.6 |
| 2010/0215183 | A1* | 8/2010 | Hansson | H04R 1/1033 381/58 |
| 2012/0134503 | A1* | 5/2012 | Poulsen | H04R 29/004 381/58 |

FOREIGN PATENT DOCUMENTS

| | | |
|---|---|---|
| CN | 102761804 | 10/2012 |
| CN | 202759419 | 2/2013 |
| JP | 2004056309 | 2/2004 |
| JP | 2004328419 | 11/2004 |

* cited by examiner

ADAPTIVE METHOD AND DEVICE OF AUDIO INTERFACE AND ELECTRONIC SIGNATURE TOKEN

CROSS-REFERENCE TO RELATED APPLICATION

This application claims priority of Chinese Patent Application Serial No. 201210200678.5, filed with the State Intellectual Property Office of P. R. China on Jun. 14, 2012, the entire disclosure of which is incorporated by reference herein.

FIELD

The present invention generally relates to an electronic technical field, and more particularly relates to an adaptive method of an audio interface, an adaptive device of an audio interface and an electronic signature token.

BACKGROUND

An audio interface (such as a headphone jack) of an existing audio signal sending apparatus (such as a mobile communication terminal) and an audio interface of an audio signal receiving apparatus (such as an electronic signature token, an audio signal adapter device, and other audio signal receiving apparatuses which receive and process audio signals via their audio output pins) generally use a four-section interface, in which a third pin and a fourth pin are audio output pins, i.e., a left-channel pin and a right-channel pin respectively. However, a first pin and a second pin of different types of audio interfaces play different roles, that is, there are two types of audio interfaces: the first pin is a MIC pin (a microphone pin) and the second pin is a GND pin (a ground pin); the first pin is a GND pin and the second pin is a MIC pin.

As different types of audio interfaces exist, when the ground pin of the audio interface of the audio signal sending apparatus is not connected with the ground pin of the audio interface of the audio signal receiving apparatus, the audio signal sending apparatus cannot communicate with the audio signal receiving apparatus normally.

Therefore, whether for designing the audio signal receiving apparatus which can be adaptively matched with different audio interfaces of the audio signal sending apparatus, or prompting a user whether the audio interface is matched by using a voice or text prompt function of the audio signal receiving apparatus, the type of the audio interface should be firstly identified in the audio signal receiving apparatus, such that the type of the audio interface of the audio signal sending apparatus connected with the audio signal receiving apparatus can be identified, and the identified ground pin of the audio signal sending apparatus can be connected with the ground pin of the audio signal receiving apparatus, thus achieving the normal communication between the audio signal sending apparatus and the audio signal receiving apparatus.

SUMMARY

The present disclosure seeks to overcome at least one of the above defects.

For this, an objective of the present disclosure is to provide an adaptive method of an audio interface.

Another objective of the present disclosure is to provide an adaptive device of an audio interface.

Yet another objective of the present disclosure is to provide an electronic signature token.

To achieve the above objectives, embodiments of a first aspect of the present disclosure provide an adaptive method of an audio interface. The audio interface comprises a first pin and a second pin, the first pin is one of a microphone pin and a ground pin of the audio interface, and the second pin is the other one of the microphone pin and the ground pin of the audio interface. The method comprises: not implementing an identification operation on the first pin and the second pin of the audio interface when an absolute value of a voltage difference between the first pin and the second pin is less than a first threshold; determining a type of each of the first pin and the second pin according to a sign of the voltage difference when the absolute value of the voltage difference between the first pin and the second pin is greater than or equal to a second threshold, in which the second threshold is greater than or equal to the first threshold; and connecting the identified ground pin to a common ground. When the absolute value of the voltage difference is greater than or equal to the second threshold and the voltage difference is positive, the first pin is determined as the microphone pin and the second pin is determined as the ground pin. When the absolute value of the voltage difference is greater than or equal to the second threshold and the voltage difference is negative, the first pin is determined as the ground pin and the second pin is determined as the microphone pin.

Furthermore, when the second threshold is greater than the first threshold and the absolute value of the voltage difference is between the first threshold and the second threshold, the identification operation is not implemented on the first pin and the second pin of the audio interface, or an identification operation is implemented on the first pin and the second pin of the audio interface. When the identification operation is implemented on the first pin and the second pin of the audio interface, the type of each of the first pin and the second pin is determined according to the sign of the voltage difference.

Furthermore, connecting the identified ground pin to a common ground comprises connecting the identified ground pin of the audio interface to the common ground via a switching module, in which the identified ground pin of the audio interface is connected with an input pin of the switching module and an output pin of the switching module is connected to the common ground.

Furthermore, the method further comprises: connecting the identified microphone pin with an audio signal input device.

Furthermore, the voltage difference is obtained by: measuring the voltage difference between the first pin and the second pin directly; or measuring voltage values of the first pin and the second pin with respect to a reference voltage, and calculating a difference value between the voltage values.

Furthermore, the voltage difference is compared with the first threshold or the second threshold via a triode, a comparator, a processor or a combination thereof.

Embodiments of a second aspect of the present disclosure provide an adaptive device of an audio interface. The audio interface comprises a first pin and a second pin, the first pin is one of a microphone pin and a ground pin of the audio interface, and the second pin is the other one of the microphone pin and the ground pin of the audio interface. The adaptive device comprises a determining module and a switching module. The determining module is configured to not implement an identification operation on the first pin and the second pin when an absolute value of a voltage difference between the first pin and the second pin is less than a first threshold, to determine a type of each of the first pin and the second pin according to a sign of the voltage difference when the absolute value of the voltage difference is greater than or equal to a second threshold, in which the second threshold is greater than the first threshold, the first pin is determined as the microphone pin and the second pin is determined as the ground pin when the absolute value of the voltage difference is greater than or equal to the second threshold and the voltage difference is positive, and the first pin is determined as the ground pin and the second pin is determined as the microphone pin when the absolute value of the voltage difference is greater than or equal to the second threshold and the voltage difference is negative. The switching module is configured to connect the ground pin determined by the determining module to a common ground.

Furthermore, when the second threshold is greater than the first threshold and the absolute value of the voltage difference is between the first threshold and the second threshold, the determining module is further configured to not implement the identification operation on the first pin and the second pin of the audio interface, or to implement the identification operation on the first pin and the second pin of the audio interface. When the identification operation is implemented on the first pin and the second pin of the audio interface, the type of each of the first pin and the second pin is determined according to the sign of the voltage difference.

Furthermore, the switching module is further configured to connect the identified ground pin of the audio interface to the common ground by connecting the common ground with an output pin of the switching module and connecting the identified ground pin of the audio interface with an input pin of the switching module.

Furthermore, the identified microphone pin is connected with an audio signal input device.

Furthermore, the adaptive device further comprises a measuring module configured to measure the voltage difference between the first pin and the second pin directly or to measure voltage values of the first pin and the second pin with respect to a reference voltage and to calculate a difference value between the voltage values.

Furthermore, the determining module comprises a triode, a comparator, a processor or a combination thereof.

Embodiments of a third aspect of the present disclosure provide an electronic signature token comprising the above mentioned adaptive device of the audio interface.

According to embodiments of the present disclosure, the type of the connected audio interface can be detected accurately at a low cost, and by connecting the detected ground pin to the common ground of the audio signal receiving apparatus, the normal communication between the audio signal sending apparatus and the audio signal receiving apparatus via the audio interface can be ensured.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
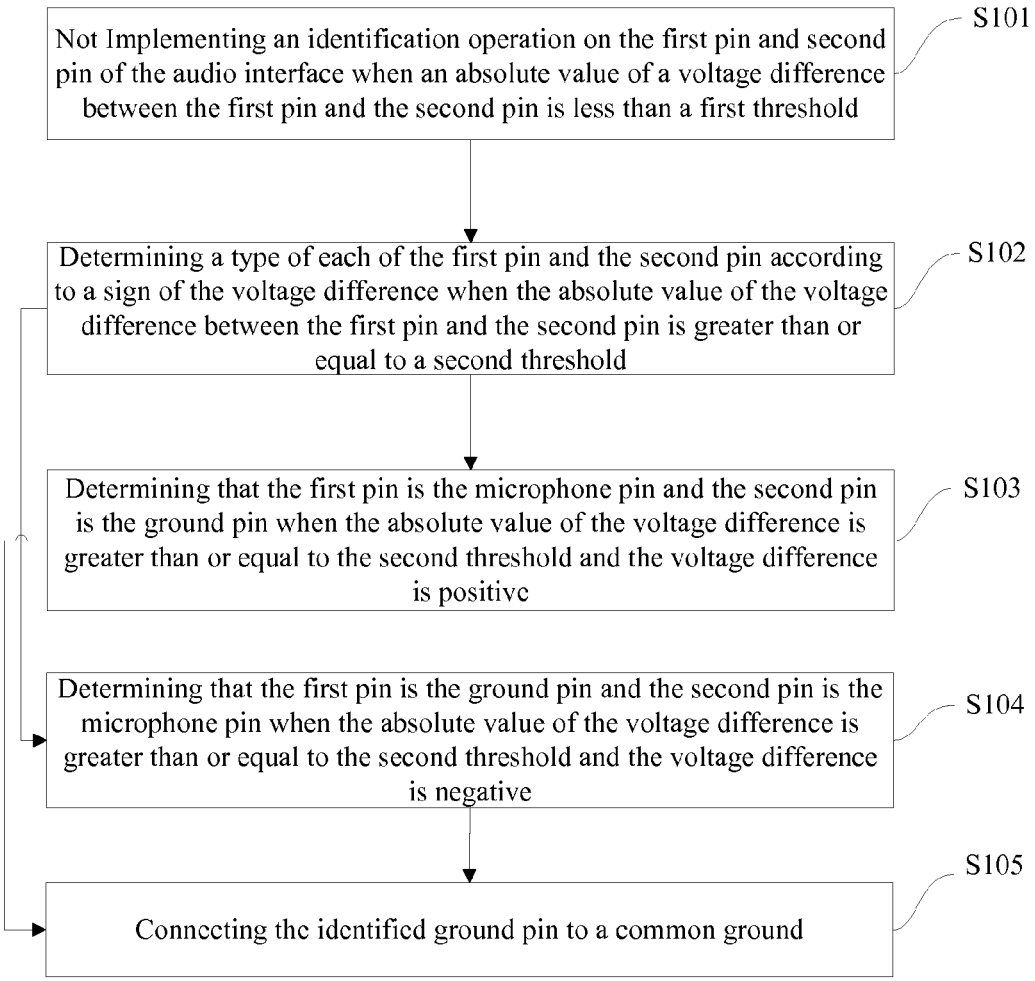
FIG. 1 is a flow chart of an adaptive method of an audio interface according to a first embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

It is to be understood that phraseology and terminology used herein with reference to device or element orientation (such as, terms like "center", "longitudinal", "lateral" "up", "down", "front", "rear", "left", "right", "vertical", "horizontal", "top", "bottom", "inside", "outside") are only used to simplify description of the present invention, and do not indicate or imply that the device or element referred to must have or operated in a particular orientation. They cannot be seen as limits to the present disclosure. Moreover, terms of "first" and "second" are only used for description and cannot be seen as indicating or implying relative importance. Further, "first pin" and "second pin" are only used for distinguishing pins and not used for defining positions of the pins.

In the description of the present disclosure, it is to be explained that terms of "installation", "linkage" and "connection" shall be understood broadly, for example, it could be permanent connection, removable connection or integral connection; it could be mechanical connection or electric connection; it could be direct linkage, indirect linkage or inside linkage within two elements. Those skilled in the art shall understand the concrete notations of the terms mentioned above according to specific circumstances.

In the following, an adaptive method and device of an audio interface and an electronic signature toke according to embodiments of the present disclosure will be described in detail with reference to drawings.

In embodiments of the present disclosure, the audio interface comprises a first pin and a second pin. In specific examples of the present disclosure, the first pin and the second pin of the audio interface are defined as follows: the first pin is one of a MIC pin (microphone pin) and a GND pin (ground pin) of the audio interface, and the second pin is the other one of the MIC pin and the GND pin of the audio interface.

In embodiments of the present disclosure, the audio interface may be any four-section headphone plug or headphone jack, such as the headphone plug or headphone jack with a diameter of 3.5 mm or 2.5 mm.

When the audio interface in the present disclosure is the headphone plug, the audio interface of the identification apparatus according to the present disclosure can be inserted into a headphone jack of an audio signal sending apparatus (for example, a mobile terminal) directly. When the audio interface in the present disclosure is the headphone jack, it can be connected with the headphone jack of the audio signal sending apparatus via an adapter cable having two headphone plugs at two ends thereof.

First Embodiment

FIG. 1 is a flow chart of an adaptive method of an audio interface. Referring to FIG. 1, the method comprises following steps.

At step S101, an identification operation is not implemented on the first pin and the second pin of the audio interface when an absolute value of a voltage difference between the first pin and the second pin is less than a first threshold.

At step S102, a type of each of the first pin and the second pin is determined according to a sign of the voltage difference when the absolute value of the voltage difference between the first pin and the second pin is greater than or equal to a second threshold.

The second threshold is greater than or equal to the first threshold. Specifically, the first threshold generally ranges from 0 to 1V, preferably, the first threshold ranges from 0.4V to 0.6V, and further, the first threshold may be 0.5V. The second threshold generally ranges from 0 to 1.5V, preferably, the second threshold ranges from 0.6V to 0.8V, and further, the second threshold may be 0.7V.

At step S103, the first pin is determined as the microphone pin and the second pin is determined as the ground pin when the absolute value of the voltage difference is greater than or equal to the second threshold and the voltage difference is positive.

At step S104, the first pin is determined as the ground pin and the second pin is determined as the microphone pin when the absolute value of the voltage difference is greater than or equal to the second threshold and the voltage difference is negative.

Specifically, for example, if the second threshold is 0.7V, when the voltage difference between the first pin and the second pin is greater than 0.7V, the first pin is determined as the microphone pin and the second pin is determined as the ground pin; when the voltage difference between the first pin and the second pin is less than −0.7V, the first pin is determined as the ground pin and the second pin is determined as the microphone pin.

Specifically, when the second threshold is greater than the first threshold and the absolute value of the voltage difference is between the first threshold and the second threshold, the identification operation is not implemented on the first pin and the second pin of the audio interface; or an identification operation is implemented on the first pin and the second pin of the audio interface, i.e., the type of each of the first pin and the second pin is determined according to the sign of the voltage difference.

At step S105, the identified ground pin is connected to a common ground.

Specifically, the identified ground pin of the audio interface (ground pin of the audio signal sending apparatus) can be connected to the common ground via a switching module, in which the identified ground pin is connected with an input pin of the switching module, and an output pin of the switching module is connected to the common ground. The switching module may use a chip such as NX3L2267, STG3682QTR or AOZ6184.

According to embodiments of the present disclosure, the type of the connected audio interface can be detected accurately at a low cost, and by connecting the detected ground pin to the common ground of the audio signal receiving apparatus, a normal communication between the audio signal sending apparatus and the audio signal receiving apparatus can be ensured.

Certainly, in order to achieve a bidirectional communication between the audio signal sending apparatus and the audio signal receiving apparatus, the identified microphone pin is also needed to connect with an audio signal input device in the audio signal receiving apparatus to ensure an uplink communication of the audio signal. In this embodiment, the identified microphone pin can be connected with the audio signal input device in the audio signal receiving apparatus via the switching module.

In this embodiment, the voltage difference is obtained by following means: measuring the voltage difference between the first pin and the second pin directly; or measuring voltage values of the first pin and the second with respect to a reference voltage respectively and calculating a difference value between the voltage values.

In this embodiment, the type of the audio interface can be determined in hardware or software.

When the type of the audio interface is determined in hardware, the voltage difference can be compared with the first threshold or the second threshold via a triode and/or a comparator, so as to determine the type of the audio interface.

When the type of the audio interface is determined in software, the voltage difference can be calculated via a processor. Certainly, the processor may include an analog-to-digital conversion module and/or a processing module.

Certainly, the type of the audio interface can be determined by means of a combination of hardware and software.

Second Embodiment

Figure 2:
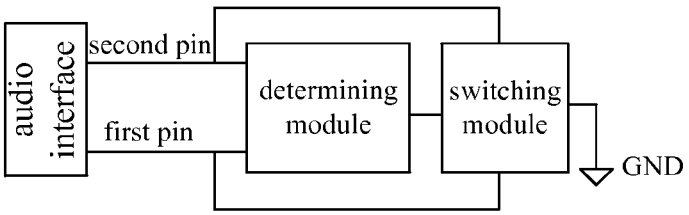
FIG. 2 is a schematic diagram of an adaptive device of an audio interface according to a second embodiment of the present disclosure.

FIG. 2 is a schematic diagram of an adaptive device of an audio interface according to a second embodiment of the present disclosure. Referring to FIG. 2, the adaptive device of the audio interface comprises a determining module and a switching module.

The determining module is configured to not implement an identification operation on the first pin and the second pin of the audio interface when the absolute value of the voltage difference between the first pin and the second pin is less than a first threshold, to determine a type of each of the first pin and the second pin of the audio interface according to the sign of the voltage difference when the absolute value of the voltage difference between the first pin and the second pin is greater than or equal to a second threshold, in which the second threshold is greater than or equal to the first threshold, the first pin is determined as the microphone pin and the second pin is determined as the ground pin when the absolute value of the voltage difference is greater than or equal to the second threshold and the voltage difference is positive, and the first pin is determined as the ground pin and the second pin is determined as the microphone pin when the absolute value of the voltage difference is greater than or equal to the second threshold and the voltage difference is negative.

Certainly, when the second threshold is greater than the first threshold and the absolute value of the voltage difference is between the first threshold and the second threshold, the determining module is further configured to not implement identification operation on the first pin and the second pin of the audio interface, or to implement the identification operation on the first pin and the second pin of the audio interface, i.e., determine the type of each of the first pin and the second pin of the audio interface according to the sign of the voltage difference.

Specifically, the first threshold generally ranges from 0 to 1V, preferably, the first threshold ranges from 0.4V to 0.6V, and further, the first threshold may be 0.5V. The second threshold generally ranges from 0 to 1.5V, preferably, the second threshold ranges from 0.6V to 0.8V, and further, the second threshold may be 0.7V.

The switching module is configured to connect the ground pin determined by the determining module to the common ground.

Specifically, the switching module connects the identified ground pin of the audio interface (ground pin of the audio signal sending apparatus) connected to the input pin of the switching module to the common ground connected with the output pin of the switching module. The switching module may use a chip such as NX3L2267, STG3682QTR or AOZ6184.

According to embodiments of the present disclosure, the type of the connected audio interface can be detected accurately at a low cost, and by connecting the detected ground pin to the common ground of the audio signal receiving apparatus, a normal communication between the audio signal sending apparatus and the audio signal receiving apparatus can be ensured.

Certainly, in order to achieve a bidirectional communication between the audio signal sending apparatus and the audio signal receiving apparatus, the identified microphone pin is also needed to connect with an audio signal input device in the audio signal receiving apparatus to ensure an uplink communication of the audio signal. In this embodiment, the identified microphone pin can be connected with the audio signal input device in the audio signal receiving apparatus via the switching module.

Third Embodiment

Figure 3:
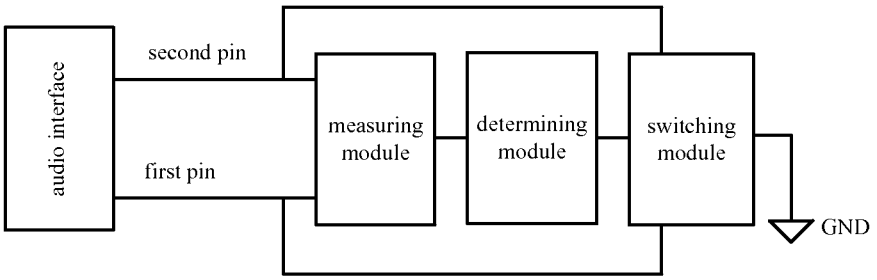
FIG. 3 is a schematic diagram of an adaptive device of an audio interface according to a third embodiment of the present disclosure.

Based on the second embodiment, FIG. 3 shows a schematic diagram of an adaptive device of an audio interface according to a third embodiment of the present disclosure. Referring to FIG. 3, the adaptive device of the audio interface may further comprise a measuring module. The measuring module is configured to measure the voltage difference between the first pin and the second pin directly. Alternatively, the measuring module is configured to measure voltage values of the first pin and the second pin with respect to a reference voltage respectively, to calculate a difference value between the voltage values. The measuring module sends the measuring result to the determining module, such that the determining module can determine the type of the audio interface, so as to make the switching module connect the identified ground pin to the common ground.

Certainly, in this embodiment, the measuring module may comprise a first measuring unit and a second measuring unit for measuring the voltage values of the first pin and the second pin respectively.

Certainly, functions of the determining module of the present disclosure may be achieved by a processor, or by a comparator and/or a triode. Moreover, functions of the determining module may be achieved by means of a combination of hardware and software.

The details are explained in the fourth embodiment and the fifth embodiment.

Fourth Embodiment

Figure 4:
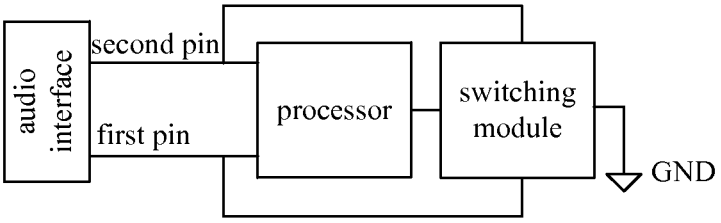
FIG. 4 is a first schematic diagram of an adaptive device of an audio interface according to a fourth embodiment of the present disclosure.

FIG. 4 is a schematic diagram of an adaptive device of an audio interface according to a fourth embodiment of the present disclosure. Referring to FIG. 4, functions of the determining module may be achieved by a processor, i.e. the processor is connected with the first pin and the second pin directly and configured to identify the type of the first pin and the second pin.

Figure 5:
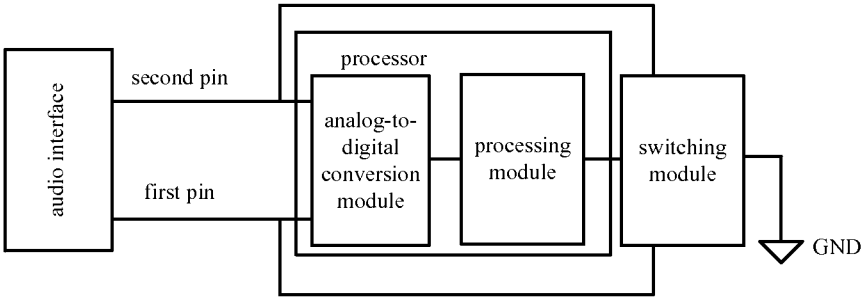
FIG. 5 is a second schematic diagram of an adaptive device of an audio interface according to the fourth embodiment of the present disclosure.

Alternatively, as shown in FIG. 5, the processor may comprise an analog-to-digital conversion module and a processing module. The analog-to-digital conversion module is configured to convert the voltage values of the first pin and the second pin to digital signals and to send the digital signals to the processing module for identifying.

Figure 6:
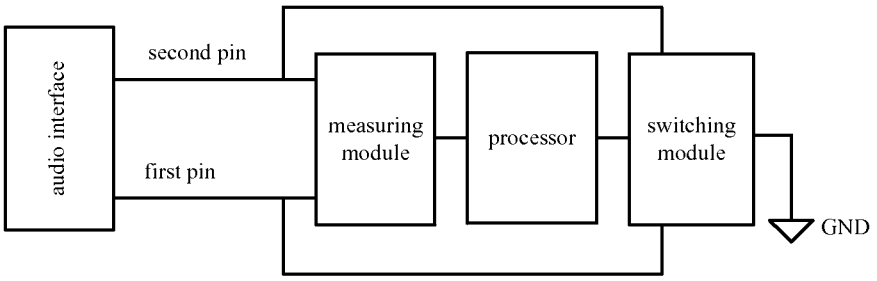
FIG. 6 is a third schematic diagram of an adaptive device of an audio interface according to the fourth embodiment of the present disclosure.

Alternatively, as shown in FIG. 6, the voltage values of the first pin and the second pin may be measured by the measuring module, and the measuring result is sent to the processor for comparing and identifying.

Figure 7:
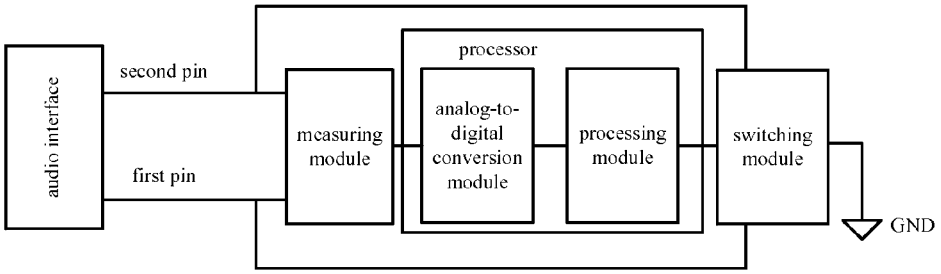
FIG. 7 is a fourth schematic diagram of an adaptive device of an audio interface according to the fourth embodiment of the present disclosure.

Certainly, the determining module may also be implemented as shown in FIG. 7, in which the voltage values of the first pin and the second pin are measured by the measuring module and converted to digital voltage signals by the analog-to-digital conversion module, and then the digital voltage signals are sent to the processing module for comparing and identifying.

Fifth Embodiment

Figure 8:
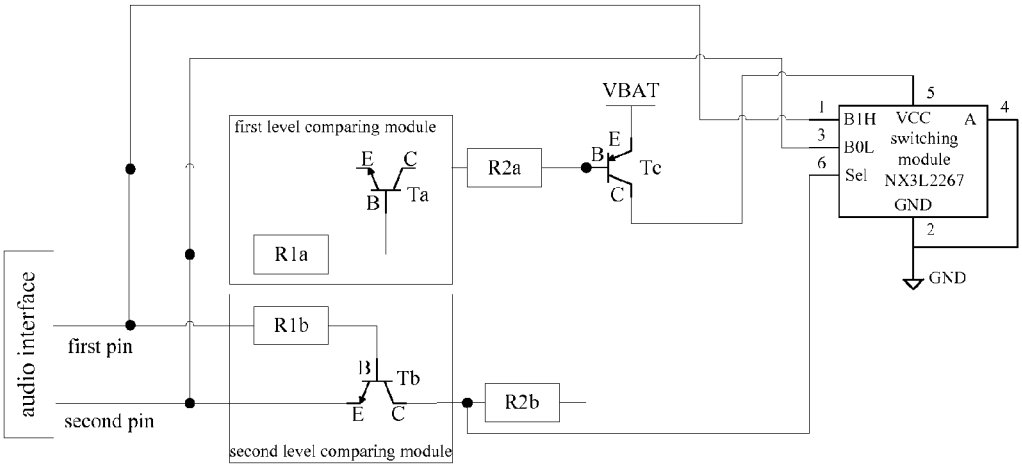
FIG. 8 is a fifth schematic diagram of an adaptive device of an audio interface according to a fourth embodiment of the present disclosure.

FIG. 8 is a schematic diagram of an adaptive device of an audio interface according to a fifth embodiment of the present disclosure. Referring to FIG. 8, the determining module adopts the triode to compare the voltage of the first pin with that of the second pin. In the embodiment shown in FIG. 8, the determining module is configured to have some triodes, and the switching module is configured as a chip (for example, NX3L2267). Certainly, the switching module may also be a chip of STG3682QTR or AOZ6184 instead of NX3L2267.

In this embodiment, the adaptive device of the audio interface comprises an audio interface, a first level comparing module, a second level comparing module, a triode Tc, a power output terminal VBAT, a switching module and resistors R2*a*, R2*b*, etc. In other words, the determining module comprises the first level comparing module and the second level comparing module.

The first level comparing module comprises a triode Ta, and the second level comparing module comprises a triode Tb.

The triodes Ta and Tb are NPN-type triodes, and the triode Tc is a PNP-type triode.

A base (B) of the triode Ta is connected with the second pin, an emitter (E) of the triode Ta is connected with the first pin, and a collector (C) of the triode Ta is connected with a base (B) of the triode Tc via the resistor R2*a*.

Furthermore, the base (B) of the triode Ta can be connected with the second pin via a resistor R1*a*.

A base (B) of the triode Tb is connected with the first pin, an emitter (E) of the triode Tb is connected with the second pin, and a collector (C) of the triode Tb is connected with a signal input pin (Sel) of the switching module and connected with a base (B) of the triode Tc via the resistor R2*b*.

Furthermore, the base (B) of the triode Tb can be connected with the first pin via a resistor R1*b*.

The resistances of the resistors R1*a*, Rib, R2*a* and R2*b* range from 1KΩ to 1MΩ.

An emitter (E) of the triode Tc is connected with the power output terminal VBAT, and a collector (C) of the triode Tc is connected with a power input pin (VCC) of the switching module.

When an ordinary battery is used as the power source, a voltage output from the power output terminal generally ranges from 2.7V to 4.2V.

A pin B0L (can be referred to as a first input pin) of the switching module is connected with the second pin of the audio interface, a pin B1H (can be referred to as a second input pin) of the switching module is connected with the first pin of the audio interface, a ground pin (GND pin) of the switching module is connected to the common ground, a pin A (can be referred to as an output pin) of the switching module is connected to the common ground and connected with the first pin and the second pin of the audio interface respectively.

In this embodiment, when the level V1 of the first pin is greater than a sum of the level V2 of the second pin and a predetermined threshold Vg (i.e. V1>V2+Vg), the triode Ta is turned off, the triode Tb is turned on, the triode Tc is turned on, the terminal VBAT provides power to the switching module via the pin VCC, and the pin Sel of the switching module receives a low level signal, which indicates that the first pin is the microphone pin and the second pin is the ground pin.

When the level V2 of the second pin is greater than a sum of the level V1 of the first pin and the predetermined threshold Vg (i.e. V2>V1+Vg), the triode Ta is turned on, the triode Tb is turned off, the triode Tc is turned on, the terminal VBAT provides power to the switching module via the pin VCC, and the pin Sel of the switching module receives a high level signal, which indicates that the first pin is the ground pin and the second pin is the microphone pin.

The above predetermined threshold Vg is greater than or equal to 0V. In this embodiment, the threshold Vg may be a break-over voltage of the triode Ta, such as 0.3V or 0.7V.

The above "high level signal" refers to a signal whose voltage is higher than that of the "low level signal"; generally, the "low level signal" refers to a signal whose voltage is below 0.7V; the "high level signal" refers to a signal whose voltage is 0.7 times the power voltage; the same as below.

The switching module connects the pin B1H or B0L with the pin A according to the signal received by the pin Sel, such that the first pin or the second pin of the audio interface is connected to the common ground.

When the low level signal is received by the pin Sel of the switching module, the switching module connects the pin B0L with the pin A, i.e. the pin B0L/the second pin of the audio interface is connected to the common ground.

When the high level signal is received by the pin Sel of the switching module, the switching module connects the pin B1H with the pin A, i.e. the pin B1H/the first pin of the audio interface is connected to the common ground.

According to the basic principles of the present disclosure, the above embodiment may have many variations, for example:

1) exchanging the first pin with the second pin;

2) connecting the signal input pin (Sel) of the switching module to the resistor R2*a* and the collector (C) of the triode Ta.

Figure 9:
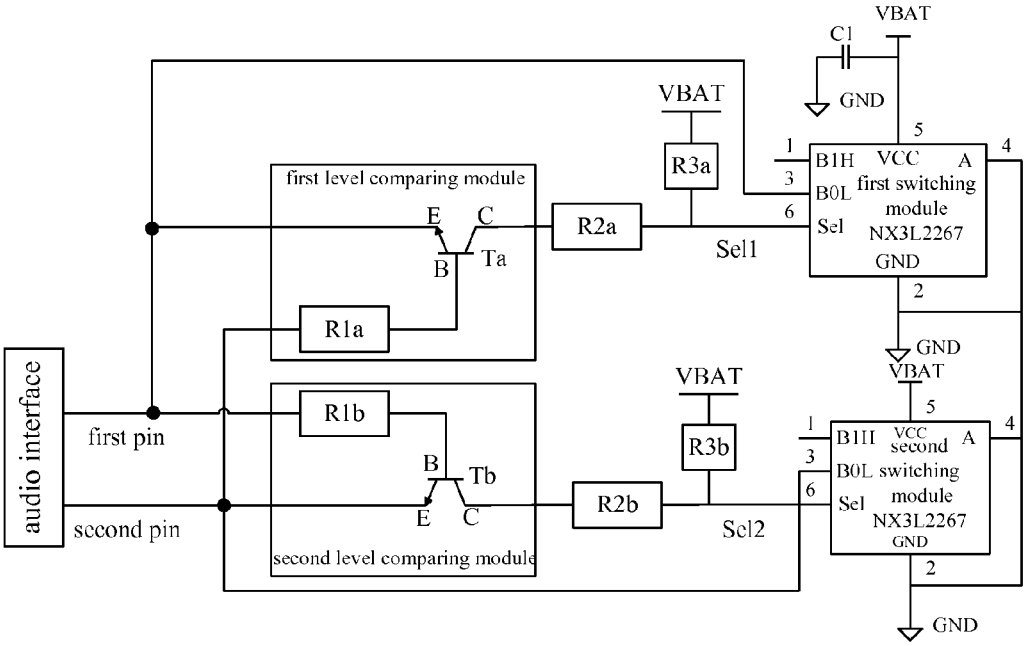
FIG. 9 is a sixth schematic diagram of an adaptive device of an audio interface according to a fourth embodiment of the present disclosure.

The adaptive device shown in FIG. 9 may also be implemented. Referring to FIG. 9, the determining module is configured to have some triodes and the switching module is configured as two chips. The determining module comprises a first level comparing module and a second level comparing module, and the switching module comprises a first switching module and a second switching module.

The first level comparing module comprises a triode Ta, and the second level comparing module comprises a triode Tb.

The triodes Ta and Tb are NPN-type triodes.

A base (B) of the triode Ta is connected with the second pin, an emitter (E) of the triode Ta is connected with the first pin, and a collector (C) of the triode Ta is connected with a power output terminal VBAT via resistors R2*a* and R3*a* and connected with a signal input pin (Sel1) of the first switching module via the resistor R2*a*.

Furthermore, the base (B) of the triode Ta can be connected with the second pin via a resistor R1*a*.

A base (B) of the triode Tb is connected with the first pin, an emitter (E) of the triode Tb is connected with the second pin, and a collector (C) of the triode Tb is connected with a power output terminal VBAT via resistors R2*b* and R3*b* and connected with a signal input pin (Sel2) of the second switching module via the resistor R2*b*.

Furthermore, the base (B) of the triode Tb can be connected with the first pin via a resistor R1*b*.

The resistances of the resistors R1*a*, R2*a*, Rib, R2*b*, R3*a* and R3*b* range from 1KΩ to 1MΩ.

When the ordinary battery is used as the power source, the voltage output from the power output terminal generally ranges from 2.7V to 4.2V.

A pin B0L of the first switching module is connected with the first pin of the audio interface, a pin B0L of the second switching module is connected with the second pin of the audio interface, and the ground pins (GND pins) of the first switching module and the second switching module are connected to the common ground.

In this embodiment, when the level V1 of the first pin is higher than a sum of the level V2 of the second pin and the predetermined threshold Vg (i.e. V1>V2+Vg), the triode Ta is turned off, the triode Tb is turned on, and the pin Sel2 of the second switching module receives the low level signal which indicates that the first pin is the microphone pin and the second pin is the ground pin.

When the level V2 of the second pin is higher than a sum of the level V1 of the first pin and the predetermined threshold Vg (i.e. V2>V1+Vg), the triode Ta is turned on, the triode Tb is turned off, and the pin Sel1 of the first switching module receives the low level signal which indicates that the first pin is the ground pin and the second pin is the microphone pin.

The second switching module connects the pin B0L with the pin A according to the low level signal received by the pin Sel2, such that the second pin of the audio interface is connected to the common ground.

When the low level signal is received by the pin Sel2 of the second switching module, the second switching module connects the pin B0L with the pin A, i.e. the pin B0L of the second switching module/the second pin of the audio interface is connected to the common ground.

The first switching module connects the pin B0L with the pin A according to the low level signal received by the pin Sel1, such that the first pin of the audio interface is connected to the common ground.

When the low level signal is received by the pin Sel1 of the first switching module, the first switching module connects the pin B0L with the pin A, i.e. the pin B0L of the first switching module/the first pin of the audio interface is connected to the common ground.

Figure 10:
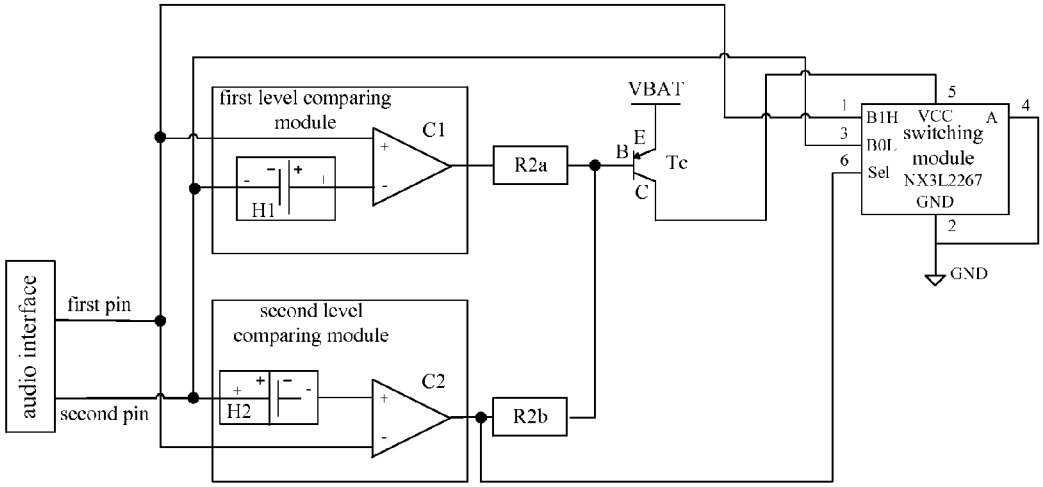
FIG. 10 is a seventh schematic diagram of an adaptive device of an audio interface according to a fourth embodiment of the present disclosure.

The adaptive device may also be implemented as shown in FIG. 10. Referring to FIG. 10, the determining module is configured to have two comparators, and the switching module is configured as one chip. The determining module comprises a first level comparing module and a second level comparing module.

The first level comparing module comprises a first reference voltage module H1 and a comparator C1.

The first pin is connected with a positive terminal of the comparator C1, the second pin is connected with a negative terminal of the comparator C1 via the first reference voltage module H1, i.e. the second pin is connected with a negative terminal of the first reference voltage module H1, and a positive terminal of the first reference voltage module H1 is connected with the negative terminal of the comparator C1.

In this embodiment, the first reference voltage module H1 may be a power source, a positive pole of the power source is the positive terminal of the first reference voltage module H1, and a negative pole of the power source is the negative terminal of the first reference voltage module H1. The voltage value provided by the first reference voltage module H1 is the threshold Vg.

In other embodiments of the present disclosure, the first reference voltage module H1 may be an element connected with the power source and adapted for providing the reference voltage (threshold voltage), such as a diode.

An output pin of the comparator C1 is connected with a base (B) of the triode Tc via a resistor R2*a*.

The second level comparing module comprises a second reference voltage module H2 and a comparator C2.

The first pin is connected with a negative terminal of the comparator C2, the second pin is connected with a positive terminal of the comparator C2 via the second reference voltage module H2, i.e. the second pin is connected with a positive terminal of the second reference voltage module H2, and a negative terminal of the second reference voltage module H2 is connected with the positive terminal of the comparator C2.

In this embodiment, the second reference voltage module H2 may be a power source, a positive pole of the power source is the positive terminal of the second reference voltage module H2, and a negative pole of the power source is the negative terminal of the second reference voltage module H2. The voltage value provided by the second reference voltage module H2 is the threshold Vg.

In other embodiments of the present disclosure, the second reference voltage module H2 may be an element connected with the power source and adapted for providing the reference voltage (threshold voltage), such as a diode.

An output pin of the comparator C2 is connected with a signal input pin (Sel) of the switching module and connected with the base (B) of the triode Tc via the resistor R2*b*.

The resistances of the resistors R2*a* and R2*b* range from 1KΩ to 1MΩ.

A pin B1H of the switching module is connected with the first pin of the audio interface, a pin B0L of the switching module is connected with the second pin of the audio interface, and a ground pin (GND pin) of the switching module is connected to the common ground.

In this embodiment, when the level V1 of the first pin is higher than a sum of the level V2 of the second pin and the threshold Vg (i.e. V1>V2+Vg), the comparator C1 of the first level comparing module outputs a high level signal, the comparator C2 of the second level comparing module outputs a low level signal, the triode Tc is turned on, the terminal VBAT provides power to the switching module via the pin VCC, and the pin Sel of the switching module receives a low level signal which indicates that the first pin is the microphone pin and the second pin is the ground pin.

When the level V2 of the second pin is higher than a sum of the level V1 of the first pin and the threshold Vg (i.e. V2>V1+Vg), the comparator C1 of the first level comparing module outputs a low level signal, the comparator C2 of the second level comparing module outputs a high level signal, the triode Tc is turned on, the terminal VBAT provides power to the switching module via the pin VCC, and the pin Sel of the switching module receives a high level signal which indicates that the first pin is the ground pin and the second pin is the microphone pin.

The switching module connects the pin B1H or B0L with the pin A according to the signal received by the pin Sel, such that the first pin or the second pin of the audio interface is connected to the common ground.

When the low level signal is received by the pin Sel of the switching module, the switching module connects the pin B0L with the pin A, i.e. the pin B0L/the second pin of the audio interface is connected to the common ground.

When the high level signal is received by the pin Sel of the switching module, the switching module connects the pin B1H with the pin A, i.e. the pin B1H/the first pin of the audio interface is connected to the common ground.

According to the basic principles of the present disclosure, the above embodiment may have many variations, for example:

1) exchanging the first pin with the second pin;

2) connecting the signal input pin (Sel) of the switching module between the resistor R2*a* and the output pin of the comparator C1.

Certainly, the switching module may be configured as two chips.

Figure 11:
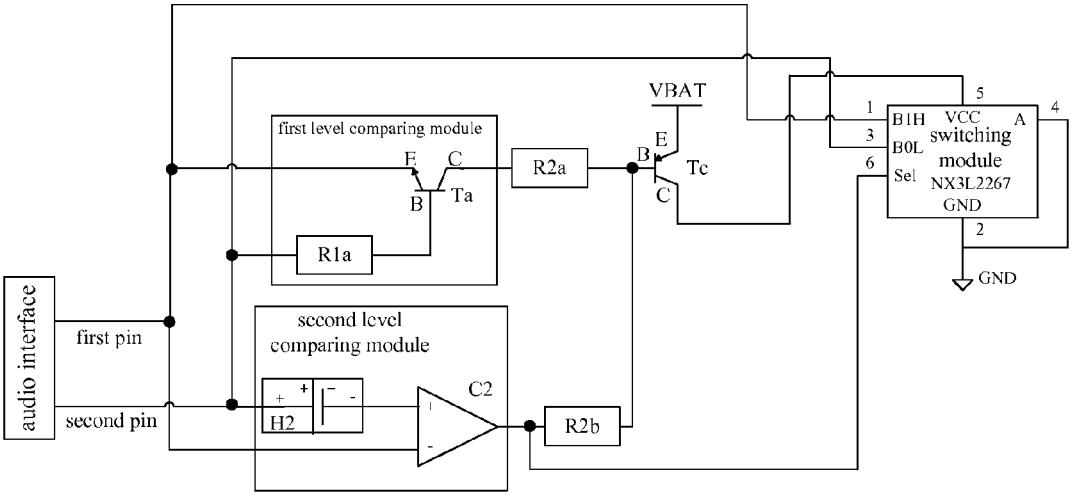
FIG. 11 is an eighth schematic diagram of an adaptive device of an audio interface according to a fourth embodiment of the present disclosure.

The adaptive device may also be implemented as shown in FIG. 11. Referring to FIG. 11, the determining module is configured to have a triode and a comparator, and the switching module is configured as one chip. The determining module comprises a first level comparing module and a second level comparing module.

The first level comparing module comprises a NPN-type triode Ta.

A base (B) of the triode Ta is connected with the second pin, an emitter (E) of the triode Ta is connected with the first pin, and a collector (C) of the triode Ta is connected with a base (B) of a triode Tc via a resistor R2*a*.

Furthermore, the base (B) of the triode Ta can be connected with the second pin via a resistor R1*a*.

The second level comparing module comprises a second reference voltage module H2 and a comparator C2.

The first pin is connected with a negative terminal of the comparator C2, the second pin is connected with a positive terminal of the comparator C2 via the second reference voltage module H2, i.e. the second pin is connected with a positive terminal of the second reference voltage module H2, and a negative terminal of the second reference voltage module H2 is connected with the positive terminal of the comparator C2.

In this embodiment, the second reference voltage module H2 may be a power source, a positive pole of the power source is the positive terminal of the second reference voltage module H2, and a negative pole of the power source is the negative terminal of the second reference voltage module H2. The voltage value provided by the second reference voltage module H2 is the threshold Vg.

In other embodiments of the present disclosure, the second reference voltage module H2 may be an element connected with the power source and adapted for providing the reference voltage (threshold voltage), such as a diode.

An output pin of the comparator C2 is connected with a signal input pin (Sel) of the switching module and connected with the base (B) of the triode Tc via a resistor R2*b*.

The resistances of the resistors R2*a* and R2*b* range from 1KΩ to 1MΩ.

A pin B1H of the switching module is connected with the first pin of the audio interface, a pin B0L of the switching module is connected with the second pin of the audio interface, and a ground pin (GND pin) of the switching module is connected to the common ground.

In this embodiment, when the level V1 of the first pin is higher than a sum of the level V2 of the second pin and the threshold Vg (i.e. V1>V2+Vg), the triode Ta is turned off, the comparator C2 of the second level comparing module outputs a low level signal, the triode Tc is turned on, the terminal VBAT provides power to the switching module via the pin VCC, and the pin Sel of the switching module receives a low level signal which indicates that the first pin is the microphone pin and the second pin is the ground pin.

When the level V2 of the second pin is higher than a sum of the level V1 of the first pin and the threshold Vg (i.e. V2>V1+Vg), the triode Ta is turned on, the comparator C2 of the second level comparing module outputs a high level signal, the triode Tc is turned on, the terminal VBAT provides power to the switching module via the pin VCC, and the pin Sel of the switching module receives a high level signal which indicates that the first pin is the ground pin and the second pin is the microphone pin.

The above threshold Vg is greater than or equal to 0V. In this embodiment, the threshold Vg may be a break-over voltage of the triode Ta, such as 0.3V or 0.7V.

The switching module connects the pin B1H or B0L with the pin A according to the signal received by the pin Sel, such that the first pin or the second pin of the audio interface is connected to the common ground.

When the low level signal is received by the pin Sel of the switching module, the switching module connects the pin B0L with the pin A, i.e. the pin B0L/the second pin of the audio interface is connected to the common ground.

When the high level signal is received by the pin Sel of the switching module, the switching module connects the pin B1H with the pin A, i.e. the pin B1H/the first pin of the audio interface is connected to the common ground.

According to the basic principles of the present disclosure, the above embodiment may have many variations, for example:

1) exchanging the first pin with the second pin;

2) connecting the signal input pin (Sel) of the switching module between the resistor R2*a* and the collector (C) of the triode Ta.

Certainly, the switching module may be configured as two chips.

Sixth Embodiment

Embodiments of the present disclosure further provide an electronic signature token. The electronic signature token comprises the adaptive device of the audio interface described in any above embodiment.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. An adaptive method of an audio interface, wherein the audio interface comprises a first pin and a second pin, the first pin is one of a microphone pin and a ground pin of the audio interface, the second pin is the other one of the microphone pin and the ground pin of the audio interface, the audio interface is connected with a headphone jack of a mobile terminal, and the method comprises:

not implementing an identification operation on the first pin and the second pin of the audio interface if an absolute value of a voltage difference between the first pin and the second pin is less than a first threshold;

determining a type of each of the first pin and the second pin according to a sign of the voltage difference between the first pin and the second pin if the absolute value of the voltage difference is greater than or equal to a second threshold, in which, the second threshold is greater than or equal to the first threshold, if the absolute value of the voltage difference is greater than or equal to the second threshold and the voltage difference is positive, the first pin is determined as the microphone pin and the second pin is determined as the ground pin, and if the absolute value of the voltage difference is greater than or equal to the second threshold and the voltage difference is negative, the first pin is determined as the ground pin and the second pin is determined as the microphone pin; and connecting the identified ground pin to a common ground.

2. The method according to claim 1, further comprising: if the second threshold is greater than the first threshold and the absolute value of the voltage difference is between the first threshold and the second threshold, not implementing the identification operation on the first pin and the second pin of the audio interface; or implementing the identification operation on the first pin and the second pin of the audio interface, in which the type of each of the first pin and the second pin is determined according to the sign of the voltage difference.

3. The method according to claim 1, wherein connecting the identified ground pin to a common ground comprises:

connecting the identified ground pin of the audio interface to the common ground via a switching circuit, in which the identified ground pin of the audio interface is connected with an input pin of the switching circuit, and an output pin of the switching circuit is connected to the common ground.

4. The method according to claim 1, further comprising:

connecting the identified microphone pin with an audio signal input device.

5. The method according to claim 1, wherein the voltage difference is obtained by:

measuring the voltage difference between the first pin and the second pin directly; or measuring voltage values of the first pin and the second pin with respect to a reference voltage, and calculating a difference value between the voltage values.

6. The method according to claim 1, wherein the voltage difference is compared with the first threshold or the second threshold via a triode, a comparator, a processor or a combination thereof.

7. An adaptive device of an audio interface, wherein the audio interface comprises a first pin and a second pin, the first pin is one of a microphone pin and a ground pin of the audio interface, the second pin is the other one of the microphone pin and the ground pin of the audio interface, the audio interface is connected with a headphone jack of a mobile terminal and the adaptive device comprises a determining circuit and a switching circuit, the determining circuit is configured to not implement an identification operation on the first pin and the second pin if an absolute value of a voltage difference between the first pin and the second pin is less than a first threshold, and to determine a type of each of the first pin and the second pin according to a sign of the voltage difference if the absolute value of the voltage difference is greater than or equal to a second threshold, in which, the second threshold is greater than or equal to the first threshold, the first pin is determined as the microphone pin and the second pin is determined as the ground pin if the absolute value of the voltage difference is greater than or equal to the second threshold and the voltage difference is positive, and the first pin is determined as the ground pin and the second pin is determined as the microphone pin if the absolute value of the voltage difference is greater than or equal to the second threshold and the voltage difference is negative;

the switching circuit is configured to connect the ground pin determined by the determining circuit to a common ground.

8. The device according to claim 7, wherein if the second threshold is greater than the first threshold and the absolute value of the voltage difference is between the first threshold and the second threshold, the determining circuit is further configured to not implement the identification operation on the first pin and the second pin of the audio interface, or to implement the identification operation on the first pin and the second pin of the audio interface, in which the type of each of the first pin and the second pin of the audio interface is determined according to the sign of the voltage interface when the identification operation is implemented on the first pin and the second pin of the audio interface.

9. The device according to claim 7, wherein the switching circuit is further configured to connect the identified ground pin of the audio interface to the common ground by connecting the common ground with an output pin of the switching circuit and connecting the identified ground pin of the audio interface with an input pin of the switching circuit.

10. The device according to claim 7, wherein the identified microphone pin is connected with an audio signal input device.

11. The device according to claim 7, further comprising a measuring circuit configured to measure the voltage difference between the first pin and the second pin directly or to measure voltage values of the first pin and the second pin with respect to a reference voltage and to calculate a difference value between the voltage values.

12. The device according to claim 7, wherein the determining circuit comprises a triode, a comparator, a processor or a combination thereof.

13. An electronic signature token, comprising an adaptive device of an audio interface, wherein the audio interface comprises a first pin and a second pin, the first pin is one of a microphone pin and a ground pin of the audio interface, the second pin is the other one of the microphone pin and the ground pin of the audio interface, the audio interface is connected with a headphone jack of a mobile terminal, and the adaptive device comprises a determining circuit and a switching circuit, the determining circuit is configured to not implement an identification operation on the first pin and the second pin if an absolute value of a voltage difference between the first pin and the second pin is less than a first threshold, and to determine a type of each of the first pin and the second pin according to a sign of the voltage difference if the absolute value of the voltage difference is greater than or equal to a second threshold, in which, the second threshold is greater than or equal to the first threshold, the first pin is determined as the microphone pin and the second pin is determined as the ground pin if the absolute value of the voltage difference is greater than or equal to the second threshold and the voltage difference is positive, and the first pin is determined as the ground pin and the second pin is determined as the microphone pin if the absolute value of the voltage difference is greater than or equal to the second threshold and the voltage difference is negative;

the switching circuit is configured to connect the ground pin determined by the determining circuit to a common ground.

14. The electronic signature token according to claim 13, wherein if the second threshold is greater than the first threshold and the absolute value of the voltage difference is between the first threshold and the second threshold, the determining circuit is further configured to not implement the identification operation on the first pin and the second pin of the audio interface, or to implement the identification operation on the first pin and the second pin of the audio interface, in which the type of each of the first pin and the second pin of the audio interface is determined according to the sign of the voltage interface when the identification operation is implemented on the first pin and the second pin of the audio interface.

15. The electronic signature token according to claim 13, wherein the switching circuit is further configured to connect the identified ground pin of the audio interface to the common ground by connecting the common ground with an output pin of the switching circuit and connecting the identified ground pin of the audio interface with an input pin of the switching circuit.

16. The electronic signature token according to claim 13, wherein the identified microphone pin is connected with an audio signal input device.

17. The electronic signature token according to claim 13, wherein the adaptive device further comprises a measuring circuit configured to measure the voltage difference between the first pin and the second pin directly or to measure voltage values of the first pin and the second pin with respect to a reference voltage and to calculate a difference value between the voltage values.

18. The electronic signature token according to claim 13, wherein the determining circuit comprises a triode, a comparator, a processor or a combination thereof.

* * * * *